US009339077B2

(12) United States Patent
Shuman

(10) Patent No.: US 9,339,077 B2
(45) Date of Patent: May 17, 2016

(54) INTEGRAL STORAGE CHAMBER FOR FOOTWEAR

(71) Applicant: Ashley Shuman, Montville, NJ (US)

(72) Inventor: Ashley Shuman, Montville, NJ (US)

( * ) Notice: Subject to any disclaimer, the term of this patent is extended or adjusted under 35 U.S.C. 154(b) by 174 days.

(21) Appl. No.: 14/105,169

(22) Filed: Dec. 12, 2013

(65) Prior Publication Data

US 2015/0164176 A1 Jun. 18, 2015

(51) Int. Cl.

*A43B 3/00* (2006.01)
*A43B 13/14* (2006.01)
*A43B 21/42* (2006.01)

(52) U.S. Cl.

CPC ..... *A43B 3/0031* (2013.01); *A43B 3/0047* (2013.01); *A43B 13/14* (2013.01); *A43B 21/42* (2013.01)

(58) Field of Classification Search

CPC .. A43B 3/0031; A43B 3/0047; A43B 21/142; A43B 21/433; A43B 21/52; A43B 21/42
USPC ..... 36/136, 36 R, 15, 42
See application file for complete search history.

(56) References Cited

U.S. PATENT DOCUMENTS 537,492 A 4/1895 Smith
922,499 A 5/1909 Molitor
1,058,254 A 1/1914 Halley
1,289,341 A 12/1918 Wirsching
1,751,069 A 2/1927 Blain
2,156,342 A * 5/1939 Litschert ..... A43B 21/28 36/35 B
2,478,411 A 8/1949 Martin
2,712,700 A 7/1955 Solomon
2,897,609 A * 8/1959 Bodkin ..... A43B 3/0031 36/1
2,904,901 A * 9/1959 Goldstein ..... A43B 3/0031 36/1
3,018,570 A 1/1962 Bliese
3,174,234 A 3/1965 Weitzner
3,325,918 A 6/1967 Weitzer
3,328,900 A 7/1967 Weitzner
4,280,287 A 7/1981 Gulbransen
4,384,414 A 5/1983 Gamm
4,471,539 A 9/1984 Mann
4,536,975 A 8/1985 Harrell (Continued)

FOREIGN PATENT DOCUMENTS

WO WO 00/21399 4/2000
WO WO 2005009160 3/2005

OTHER PUBLICATIONS

The Hidden Compartment Walking Shoe, www.gadgetchick.com, date downloaded Dec. 30, 2013, date published unknown.

*Primary Examiner* — Marie Bays
(74) *Attorney, Agent, or Firm* — Stephen C. Thomas

(57) ABSTRACT

A shoe, or shoe sole, with integral storage chamber is claimed. The invention may comprise a carriage that is in sliding engagement with the sole of a shoe, wherein the carriage further comprises a storage chamber for storing personal objects. The sliding engagement of the invention may comprise tongue and groove complementary surfaces. The carriage containing the storage chamber may translate in a direction along a longitudinal axis of the shoe and may be further retained onto the shoe by use of a retaining pin located on the shoe sole that is engaged in a press fit with retaining pin receiving recess on the carriage such that the carriage is securely retained in a closed position. A user may safely store objects in the storage chamber without detection and may access the objects quickly if needed. The invention may further comprise a mirror and closable heel storage chamber.

20 Claims, 13 Drawing Sheets

(56) References Cited

U.S. PATENT DOCUMENTS

| | | | | |
|---|---|---|---|---|
| 4,610,100 | A * | 9/1986 | Rhodes | A43B 21/39 36/36 A |
| 4,638,579 | A | 1/1987 | Gamm | |
| 4,644,673 | A | 2/1987 | Gamm | |
| 5,295,314 | A | 3/1994 | Moumdjian | |
| 5,311,679 | A | 5/1994 | Birch, Sr. | |
| 5,921,008 | A | 7/1999 | Ruff | |
| 5,996,261 | A | 12/1999 | Nelson | |
| 6,094,844 | A | 8/2000 | Potts | |
| 6,163,889 | A | 12/2000 | Tate | |
| 6,289,612 | B1 * | 9/2001 | Kent | A43B 3/00 36/132 |
| 7,010,869 | B1 | 3/2006 | Ellis, III | |
| 7,028,422 | B1 | 4/2006 | Lewis | |
| 2001/0052195 | A1 * | 12/2001 | Blakey | A43B 3/24 36/100 |
| 2003/0126768 | A1 | 7/2003 | Hutt | |
| 2005/0016031 | A1 | 1/2005 | Ruff | |
| 2005/0055851 | A1 * | 3/2005 | Arowolo | A43B 3/0031 36/136 |
| 2005/0172520 | A1 * | 8/2005 | Simmons-Gettig | A43B 13/14 36/136 |
| 2005/0284004 | A1 * | 12/2005 | Peters | A43B 3/00 36/136 |
| 2006/0042127 | A1 | 3/2006 | Shattuck | |
| 2007/0193064 | A1 * | 8/2007 | Xu | A43B 13/14 36/25 R |
| 2007/0199209 | A1 | 8/2007 | Schreck et al. | |
| 2009/0313857 | A1 | 12/2009 | Carnes et al. | |
| 2011/0203139 | A1 | 8/2011 | Eidson et al. | |
| 2011/0225849 | A1 | 9/2011 | Zubyk | |
| 2011/0239488 | A1 | 10/2011 | Carnes et al. | |
| 2013/0000155 | A1 | 1/2013 | Romer | |
| 2013/0086819 | A1 | 4/2013 | LeGear | |
| 2015/0164176 | A1 * | 6/2015 | Shuman | A43B 13/14 36/136 |

* cited by examiner

INTEGRAL STORAGE CHAMBER FOR FOOTWEAR

CROSS REFERENCE TO RELATED APPLICATIONS

Not applicable.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The invention is directed to the field of shoes, and more specifically is directed to a shoe, or shoe sole, which comprises an integral compartment, or chamber, for storage of items such as, by way of example and not by limitation, money, credit cards, identification cards, safety products such as pepper spray or mace, vehicle keys, house or apartment keys, or any personal or other item that the user may desire to keep close at hand for easy access. The invention is useful for any number of situations or occasions in which the storage of such personal items may be desired, but may be especially useful in certain situations, such as those occurrences when the user is in an environment in which it may be undesirable carry a bag, purse, briefcase or other portable storage apparatus. In such situations the invention provides a useful means for carrying personal items as desired by the user. The invention is also useful providing a measure of safety, as items stored in the compartment of the invention may not be apparent and may thus be overlooked in the instance in which the user of the invention is attacked or is robbed of obvious valuables such as a wallet, purse or jewelry. In such an event, an attacker may overlook the possibility that any valuables would be stored within a shoe compartment and thus the user may be spared the loss of items stored there.

Still further, the use of purses or other handheld bags or containers to carry personal objects has the drawback that such purses or bags may be bulky, are easily misplaced or unintentionally left behind in a public place, are susceptible to theft and may generally be undesirable for carrying for a number of reasons. Furthermore, the use of a wallet to carry personal objects such as money or credit cards may be undesirable in many situations, as a person's clothing may not comprise pockets that allow carrying a wallet. What is needed, therefore, is a means by which objects, for example personal objects such as money, keys, and the like, may be carried by a person with the need for a separate carrying devices such as a purse or hand carried container.

The present invention, which may include a shoe, or shoe sole, that comprises a storage chamber contained with the sole of a shoe, meets the need and is further simple to use and operate.

2. Background Art

Shoes of all types and sizes are well-known in the art. There have been prior attempts to provide storage in a shoe compartment so that a user may carry certain personal objects with them in a shoe. The attempts to provide storage in a shoe compartment in the background art have met with limited success.

For example U.S. printed patent application number US 2005/0172520 A1 describes a shoe comprising a hinge that operates to allow a front portion of the sole of a shoe to rotate downward and away from the shoe. This particular approach to providing a storage compartment within a shoe suffers from the disadvantage that the rotating front portion of the shoe may unintentionally or unexpectedly become unlatched and rotate downward without warning and may cause a user to stumble and fall if it catches on a walking surface.

Still further, U.S. Pat. No. 6,289,612 describes a shoe comprising a hollow heel portion that may be closed by inserting a male threaded element into the bottom of the heel portion. The hollow heel portion forms a storage chamber. This particular approach to providing a storage compartment within a shoe suffers from the disadvantage that the available volume for storage is limited to the heel of the shoe and may not provide enough volume for certain items such as, for instance, credit cards.

Still further, U.S. Pat. No. 2,897,609 describes a heel, specifically the heel of a boot or man's shoe, which comprises a hinge such that the heel portion of the boot or shoe rotates downward. A hollow portion in the heel forms a storage compartment or chamber that is exposed when the heel portion of the boot or shoe is rotated into a downward position so that the user may access the chamber. This particular approach to providing a storage compartment within a boot or shoe suffers from the disadvantage that the rotating heel portion of the boot or shoe may cause a user to stumble and fall if it catches on a walking surface.

Still further, U.S. Pat. No. 5,921,008 describes a compartment contained within a heel, for example, a heel of a man's boot or shoe, which further comprises a side door that opens laterally allowing a user access to the compartment contained within the heel. While this approach may be usable for a man's shoe or boot, it is not feasible for a women's shoe which comprises a narrow heel section as there is likely not enough volume available in the heel area of a typical woman's shoe, such as a high heel shoe, to allow storage of any personal objects of any appreciable size such as, for example, a credit card or set of car keys.

The cited examples of the background art may suffer from other disadvantages over and above those stated herein. What is therefore needed in the art is a shoe comprising a compartment or storage chamber for the storage of personal objects such as, for instance, credit cards money or car keys, which is contained within a portion of the shoe comprising a large enough volume to store such personal objects while reducing the likelihood that the open compartment may cause a user to trip and fall. Furthermore, it would be desirable that such a shoe and chamber combination would be easily accessible by the user. The present invention overcomes the limitations and drawbacks of shoe compartments of the background art.

BRIEF SUMMARY OF THE INVENTION

The present invention comprises an apparatus that has one or more of the following features, which alone or in any combination may comprise patentable subject matter.

In accordance with one embodiment of the present invention, the invention comprises a storage chamber disposed within a carriage that may be slidingly engaged with and located on the underneath surface of a shoe, such that a user may slide the carriage forward to an open position in order to access the storage chamber. The storage chamber may comprise a void disposed within the carriage that is exposed when the carriage is in an open position. When the carriage is in an open position the storage chamber is exposed, allowing a user to access the storage chamber in order to place or remove items therein. When the carriage is in a closed position, the storage chamber may not be exposed and thus any items stored therein may be hidden from view and safely carried by the user.

The carriage may be completely removable from the shoe. In the preferred embodiment in which the carriage is slidingly engaged with the shoe, the carriage may slide all the way off the shoe by translating the carriage toward the toe of the shoe utilizing the sliding engagement between the carriage and the shoe sole, allowing a user to completely remove the carriage for ease of access if desired. The carriage may be disposed on the underneath side of the shoe and may be slidingly engaged with the shoe by a tongue and groove sliding fit or by any manner of complementary surfaces located in the carriage or shoe sole that create a sliding engagement between the carriage and the shoe sole. The carriage may be captured in the closed position by engagement of a carriage retaining pin located on an underneath surface of the shoe sole with a retaining pin receiving recess disposed on the carriage, and in which the carriage retaining pin and retaining pin receiving recess are dimensioned such that the diameter of the carriage retaining pin and the retaining pin receiving recess form a snap fit or a slight press fit such that the pin snaps into place into the retaining pin receiving recess when the carriage is pushed towards the heel of the shoe utilizing the sliding engagement between the carriage and the shoe so that the carriage is in a closed position. This snap fit or slight press fit between the carriage retaining pin and the retaining pin receiving recess may thus retain the carriage in place during normal use of the shoe.

The invention may comprise a shoe, shoe sole and carriage as described herein. The invention may also comprise the sole and carriage as described and claimed below, without the shoe upper.

In alternate embodiments of the invention, a storage chamber or void may be provided in the heel of the shoe in which objects may be safely carried. The heel storage chamber or void may have an opening that may be closable by a male threaded plug adapted to threadingly engage with matching female threads in the chamber or void opening, forming a closed heel chamber or void when the male threads of the plug are threadingly engaged with the matching female threads in the heel chamber or void opening.

In a still further embodiment of the invention, an optically reflective plate or surface such as a mirror may be attached to an underneath surface of the shoe sole. A user may therefore remove the chamber from the shoe sole, or simply translate the chamber toward the toe end of the shoe, and may view their reflection in the optically reflective surface.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating the preferred embodiments of the invention and are not to be construed as limiting the invention. In the drawings.

DETAILED DESCRIPTION OF THE INVENTION

The following documentation provides a detailed description of the invention.

As used herein, "normal" use of the shoe means the use of the shoe during walking, storage of the shoe, and other operations using the shoe in which the storage chamber of the invention is not accessed.

As used herein, the "closed" position of the carriage is defined as the position in which the carriage is located at the heel-most position of travel of the sliding engagement between carriage and shoe.

As used herein, the "open" position of the carriage is defined as any position in which the carriage is not located at the heel-most position of travel of the sliding engagement between carriage and shoe. Thus, the carriage may be in a partially open position or a fully open position, or may be removed from the shoe altogether in some embodiments.

Figure 2:
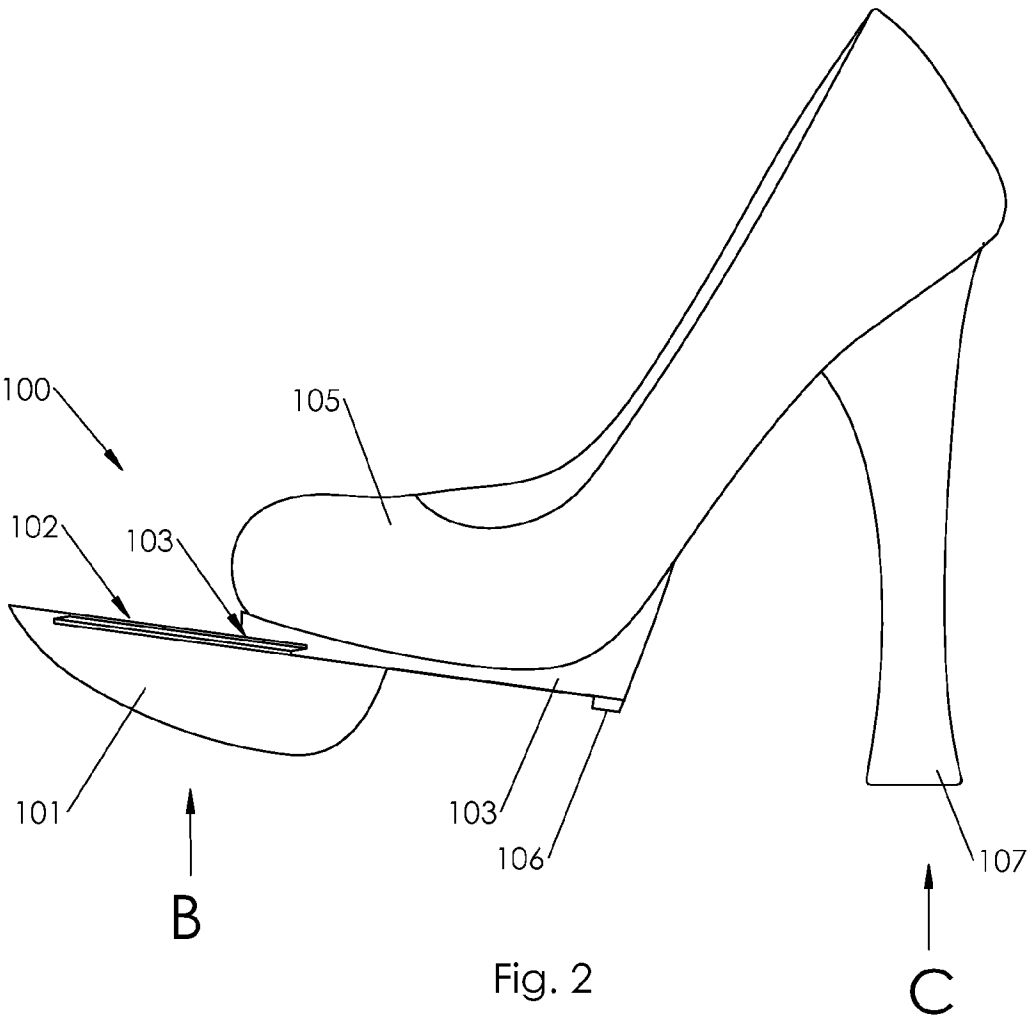
FIG. 2 depicts a side view of the invention in which the carriage is shown in an open position such that the storage chamber may be accessed by the user.

As used herein, the "toe end" or "toe side" is that end of the shoe upon which the shoe toe is located as depicted by B in FIG. 2. Also, as used herein, "toe-ward" means that direction which is toward the toe of the shoe, looking from the heel of the shoe.

As used herein, the "heel end" or "heel side" is that end of the shoe upon which the shoe heel is located as depicted by C in FIG. 2. Also, as used herein, "heel-ward" means that direction which is toward the heel of the shoe, looking from the toe of the shoe.

As used herein, "heel-most" means that position where the carriage of the invention has been translated as far to the heel end of the shoe as the sliding engagement will allow.

As used herein, "shoe" means footwear comprising a sole and a shoe upper of any style.

As used herein, "shoe upper" means the part or parts of a shoe that cover the toes, the top of the foot, the sides of the foot, and the back of the heel; and also means straps that are adapted to hold a shoe onto the foot of a wearer. An upper may comprise any type or style of footwear or materials.

As used herein, "snap fit" means a detachable attachment between two elements formed by the shape of the elements so that the elements are attached by assembling them together, wherein the shape of the elements causes a deflection or deformation in either one or both of the elements and thereby causing the two elements to be held together in a detachable attachment.

As used herein, "opposed complementary surfaces" means surfaces that are adapted to provide a sliding engagement between two objects by providing complementary features, such as, for example, tongue and groove surfaces, that are dimensioned so that when the two objects are assembled together the opposing complementary features produce a sliding engagement between the two objects allowing them to be slidingly retained together while being able to slidingly translate along a longitudinal axis.

It can be seen from the various figures of the drawings and as further described herein that the invention may comprise a storage chamber located within a carriage that is slidingly engaged with a sole of a shoe, wherein the carriage is able to be translated bi-directionally in a direction along a longitudinal axis of the shoe. The carriage of the invention, which comprises a storage chamber formed by a plurality of sidewalls and a bottom and having an open top, may be slidingly engaged with the shoe sole and may further comprise a latch comprising a snap fit, press fit or other mechanical fit to retain the chamber in a closed position in the shoe sole. The sliding engagement between the storage chamber and the shoe sole may comprise complementary sliding engagement surfaces in the top surface of the carriage and in an underneath surface of the shoe sole. The opposed complementary sliding engagement surfaces may be a tongue and groove engagement in which the tongue and groove elements are dimensioned and configured so as to form a sliding engagement between them, or may be any curvilinear or rectilinear or other shape that forms opposing complementary surfaces in the carriage and the shoe sole that form a sliding engagement between the carriage and the shoe sole. In the embodiments of the invention in which the complementary surfaces in the carriage and the shoe sole are tongue and groove embodiments, the storage chamber may comprise either the tongue or groove element of the sliding engagement, and likewise the shoe sole may comprise either the tongue or groove element.

Figure 1:
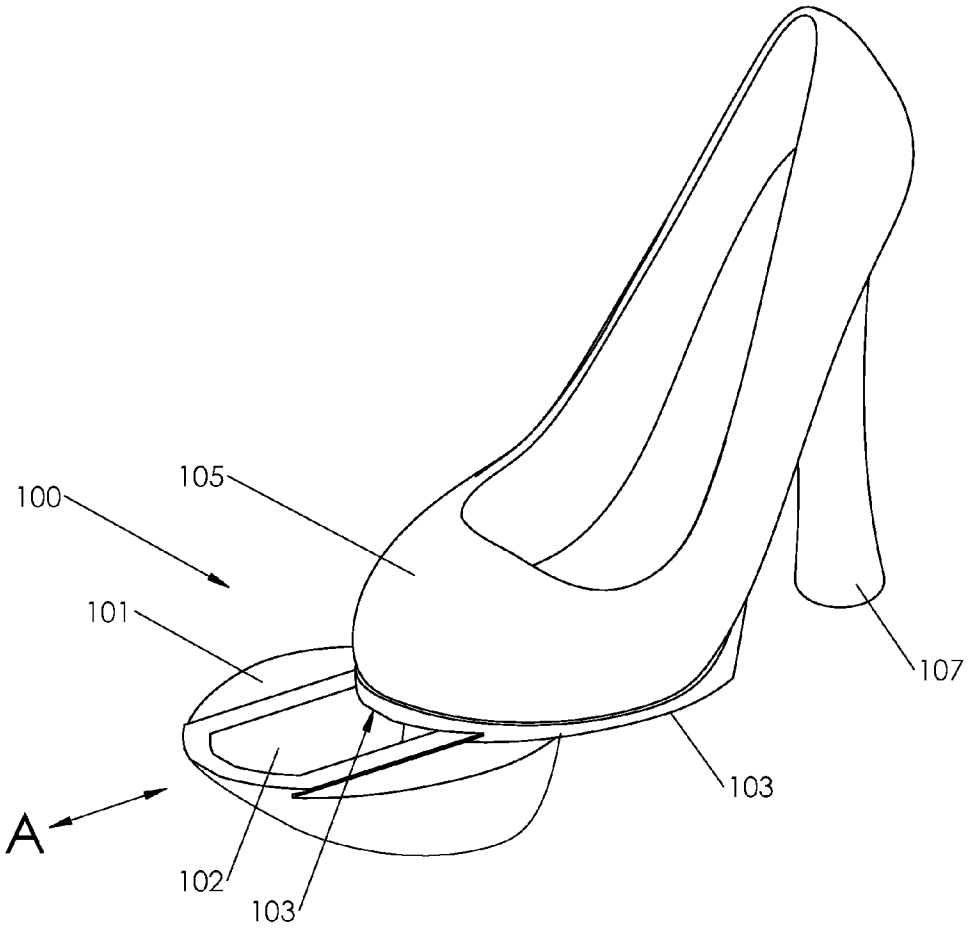
FIG. 1 depicts a perspective front view of the invention in which the carriage is shown in an open position such that the storage chamber may be accessed by the user.

Referring now to FIG. 1, a perspective front view of the shoe with integral storage chamber of the invention 100 in which the carriage 101 is shown in an open position such that the storage chamber 102 may be accessed by a user. With the carriage in this position a user may place objects in storage chamber 102, and such objects may be safely held in the storage chamber 102 when carriage 101 is returned to a closed position by translating the carriage 101 in a heel-ward direction along a longitudinal axis of the shoe as depicted by arrow A until it has reached the limit of its travel as is shown in further detail in FIG. 3. The translation of carriage 101 on shoe sole 103 along axis A may be enabled by a pair of opposed complementary surfaces 109 in carriage 101 and shoe sole 103 as is further depicted in FIGS. 4, 5, 6, 7*a*, 7*b*, 7*c*, 8 and 9. The pair of complementary surfaces in carriage 101 may be disposed on a top surface of carriage 101. The pair of opposing complementary surfaces in shoe sole 103 may be disposed on an underneath surface of carriage 103. Still referring to FIG. 1, carriage 101 may be slidingly engaged with shoe sole 103 by means of a pair of opposed complementary surfaces in carriage 101 and shoe sole 103 such that carriage 101 is adapted to translate in a heel-ward direction or toe-ward direction as the user desires. Such pair of opposed complementary surfaces may be, for example, tongue and groove complementary surfaces in alternate embodiments as is further depicted in FIGS. 6, 7*a*, 7*b*, and 7*c* or may be any other pair of opposed complementary surfaces of a cross section that allow heel-ward and toe-ward translation of carriage 101 such as the pair of opposed complementary surfaces depicted in FIGS. 8 and 9. It is to be understood that any opposed pair of complementary surfaces disposed in carriage 101 and shoe sole 103 that allow heel-ward and toe-ward translation of carriage 101 on shoe sole 103 along a longitudinal axis as depicted by arrow A are within the scope of the claimed invention. The pair of opposed complementary surfaces of the invention enable the translation of carriage 101 in the direction A shown in FIG. 1 and may also retain carriage 101 onto shoe sole 103, preventing carriage 101 from falling downward and becoming separated from shoe sole 103.

Still referring to FIG. 1, shoe upper 105 may be attached to shoe sole 103 by any the means commonly known in the art for attaching shoe uppers to shoe soles or other structural members of a shoe such as chemical bonding, stitching or other attachment means known in the art. Shoe heel 107 is shown for reference.

Referring now to FIG. 2, a side view of the invention 100 in which the carriage 101 is shown in an open position such that the storage chamber 102 may be accessed by the user. Carriage 101 has been translated along a longitudinal axis of the shoe as depicted by arrow A (not shown in FIG. 2, but shown in FIG. 1). Shoe upper 105 and shoe heel 107 are shown for reference. Shoe sole 103 may be attached to carriage 101 and may be in sliding engagement with carriage 101 such that it is able to be translated in direction arrow A along a longitudinal axis of the shoe. The invention may comprise carriage retaining pin 106 which may be located on the underneath side shoe sole 103 as shown in the figure. Carriage retaining pin 106 may be fabricated as a unitary member of shoe sole 103 or may be a separate element that is attached to shoe sole 103 by any means known in the art such as chemical bonding, threaded fasteners, staples, or any other attachment means that is known in the art of shoe fabrication. The toe end of the shoe is indicated by the reference B in the figure; the heel end of the shoe is indicated by the reference C in the figure. References B and C are shown for reference to indicate the toe end of the shoe and the heel of the shoe, respectively, for clarity sake and for further reference herein.

Figure 3:
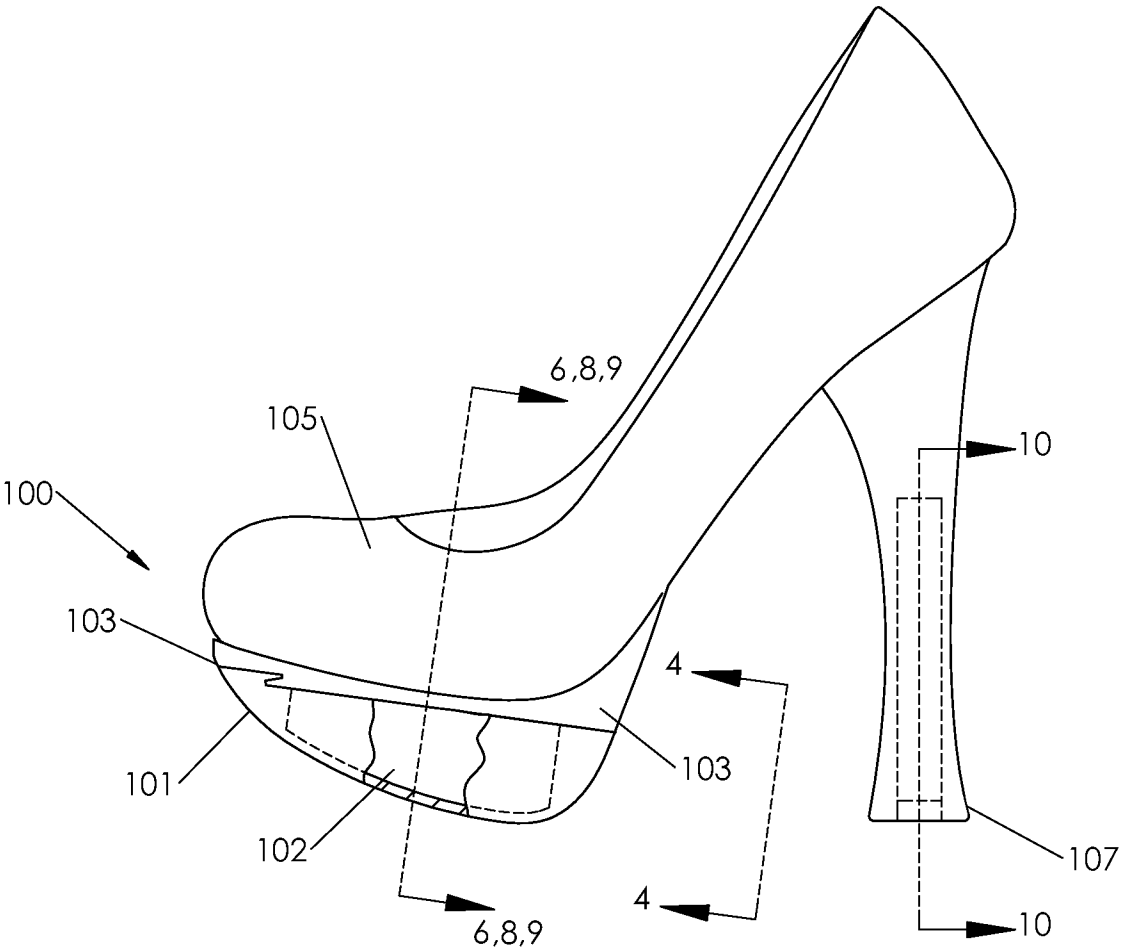
FIG. 3 depicts a side view of the invention in which the carriage is shown in a closed position such that the items in the storage chamber are protected, and in which the carriage is shown in a breakout cross section showing the storage chamber.

Referring now to FIG. 3, a side view of the invention 100 in which the carriage 101 is shown in a closed position. In this position, any objects that a user may have stored in storage chamber 102 of carriage 101 maybe safely carried by a user. It can easily be seen that such objects are concealed from observation by others, but maybe easily accessed by operation of the sliding engagement of carriage 101 with shoe sole 103. Shoe upper 105 and shoe heel 107 are shown for reference.

Figure 4:
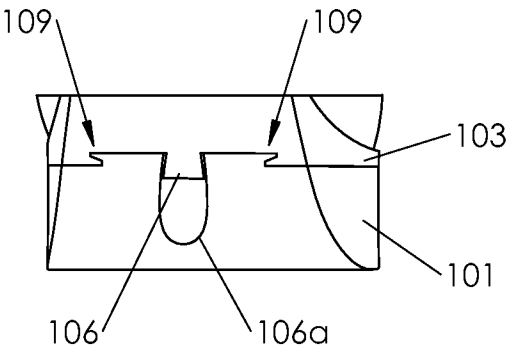
FIG. 4 depicts a rear view of the carriage of the invention in a closed position.

Referring now to FIG. 4, a rear view the invention 100 is depicted showing carriage 101 in a closed position. Carriage retaining pin 106 may be engaged in a snap fit with retaining pin receiving recess 106*a* in carriage 101. The engagement of carriage retaining pin 106 with retaining pin receiving recess 106*a* in carriage 101 may also be a press fit, sliding fit or any other manner of detachable attachment between carriage retaining pin 106 and retaining pin receiving recess 106*a*: but in any case the engagement of carriage retaining pin 106 with retaining and carriage 101 retaining pin receiving recess 106*a* in carriage 101 may provide a detachable attachment releasably securing carriage 101 to shoe sole 103 in the closed position as depicted, for instance, in FIG. 3. A user may detach carriage 101 from the shoe sole 103 by, for example, grasping carriage 101 and pulling carriage 101 towards the toe of the shoe along the sliding engagement between carriage 101 and shoe sole 103, overcoming the detachable attachment securing carriage 101 to shoe sole 103 and allowing a user to translate carriage 101 towards the toe of the shoe, further allowing the use access to storage chamber 102. Carriage retaining pin 106 is depicted as a protrusion protruding from a bottom surface of shoe sole 103 in the figures of the drawings and is shown to be a pin that is rounded on its toe-ward side and further comprising a flat surface on its heel-ward side, but carriage retaining pin 106 may comprise any shape, and likewise retaining pin receiving recess 106*a* may comprise any shape as long as they operate to releasably retain carriage 101 to shoe sole 103 when carriage 101 is in a closed position, preferably by a snap fit between retaining pin 106 and retaining pin receiving recess 106*a*. The shapes of these elements as depicted in the figures of the drawings is exemplary and are intended to show one of many shapes that may be utilized to releasably retain carriage 101 in the closed position. In a preferred embodiment of the invention, carriage retaining pin 106 and retaining pin receiving recess 106*a* form a snap fit or press fit releasably retaining carriage 101 to shoe sole 103 when carriage 101 is located in the closed position as depicted, for example, in FIG. 3. Complementary sliding engagement surfaces 109, which enable carriage 101 to translate along a longitudinal axis of the shoe on shoe sole 103, are also shown in the figure.

Figure 5:
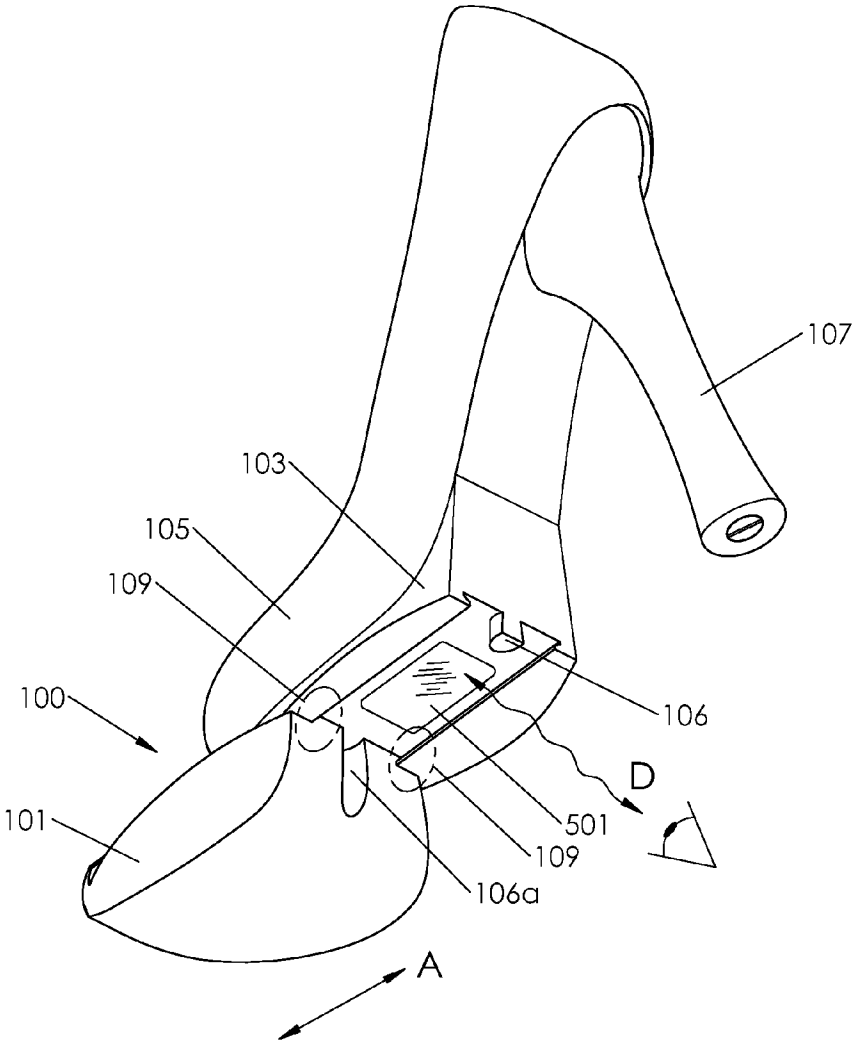
FIG. 5 depicts a bottom perspective view of invention in which the carriage is shown in an open position such that the storage chamber may be accessed by the user.

Referring now to FIG. 5, a bottom perspective view of the invention 100 is depicted in which the carriage is shown in an open position such that the storage chamber 102 (as seen in FIG. 1) may be accessed by the user. Carriage 101 has been translated towards the toe end of the shoe, allowing a user to access the storage chamber 102 located in carriage 101. The releasable connection between carriage retaining pin 106 and retaining pin receiving recess 106*a* is shown as being released, allowing carriage 101 to translate along a longitudinal axis A of the shoe on the pair of complementary sliding engagement surfaces 109 located in shoe sole 103 and in carriage 101. Shoe upper 105 and shoe heel 107 are shown for reference.

Still referring to FIG. 5, in an alternate embodiment of the invention a user may remove the shoe from a foot to view her reflection in optically reflective plate 501, which may be attached to shoe sole 103. Optically reflective plate 501 may be attached to shoe sole 103 such that a user may remove the shoe from a foot, remove carriage 101 or simply translate carriage 101 towards the toe end of the shoe using the sliding engagement between carriage 101 and shoe sole 103 so as to expose all or a part of optically reflective plate 501, and view her reflection as reflected by optically reflective plate 501. Optically reflective plate 501 is therefore oriented such that its reflective surface reflects light impinging on the underneath of the shoe, as is further depicted in FIG. 5, and a light ray E impinging on optically reflective plate 501 as reflected light ray F. Optically reflective plate 501 may be attached to shoe sole 103 by any means known in the art including but not limited to chemical bonding and all equivalents thereof.

Figure 6:
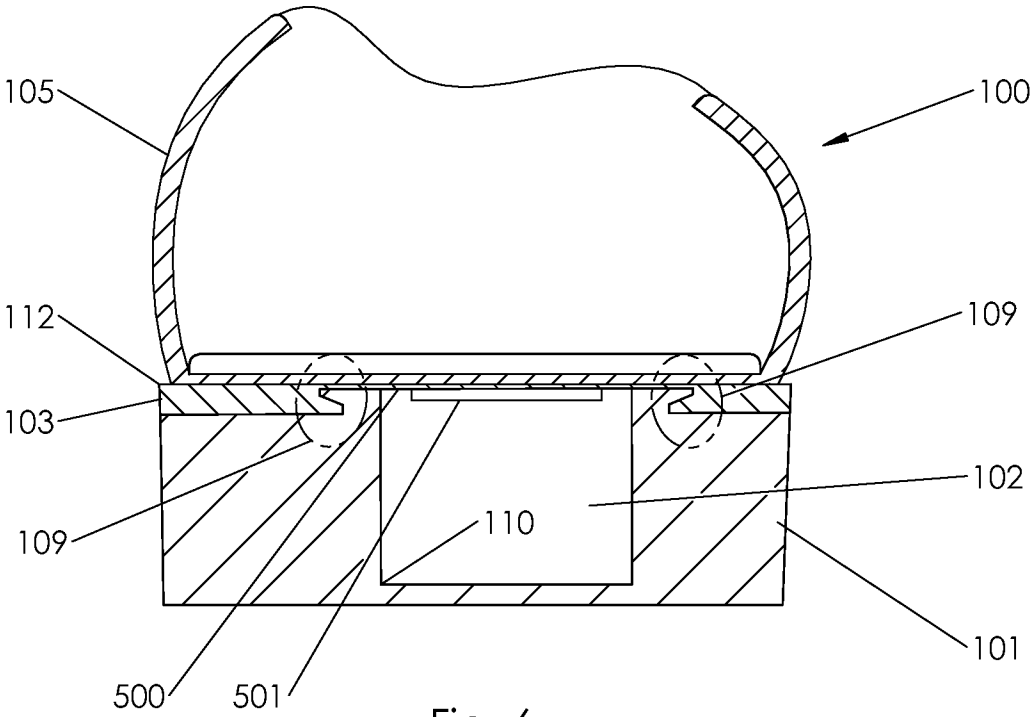
FIG. 6 depicts a cross section of the invention in which one embodiment of complementary sliding engagement surfaces allowing translation of the carriage along a longitudinal axis of the shoe is shown.

Referring now to FIG. 6, a cross section of the invention 100 is depicted in which one embodiment of a cross section of a pair of opposed complementary sliding engagement surfaces 109 is shown. The details of the pair of opposed complementary sliding engagement surfaces 109 for the embodiment shown in FIG. 6 are shown in further detail in FIG. 7*a*, and alternate embodiments of the pair of opposed complementary sliding engagement surfaces 109 are depicted in FIGS. 7*b*, 7*c*, 8 and 9. Carriage 101 may be in sliding engagement with shoe sole 103. Storage chamber 102, located in carriage 101, may be of any shape and may comprise storage chamber interior corners 110 that are rounded internal corners, square internal corners or corners of any shape. Storage chamber 102 may be rectilinear or curvilinear in shape, or may take any shape, regular or irregular, that fits within the envelope of carriage 101. Shoe upper 105 may be attached to shoe sole 103 or any intermediate structure (not shown) at sole-upper interface surface 112 by any means in the art including stitching, chemical bonding, or any means known in the art of shoe construction. Optically reflective plate 501 may be attached to reflective plate mounting surface 500 of shoe sole 103 by any means known in the art including but not limited to chemical bonding and all equivalents thereof.

Figure 7A:
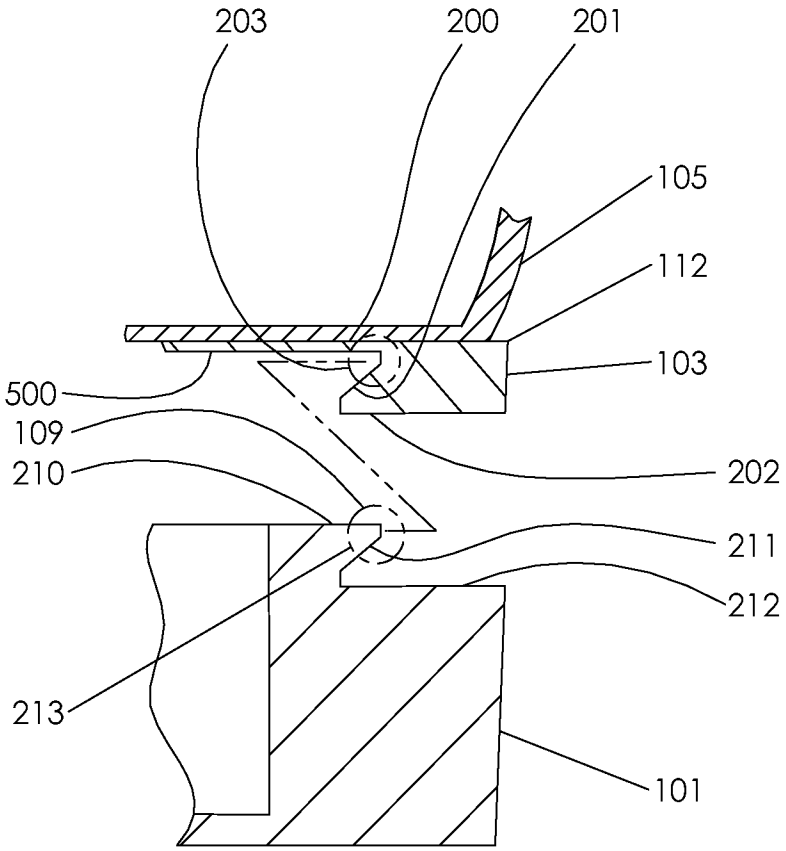
FIG. 7*a* depicts preferred embodiment of the complementary surfaces that comprise the sliding engagement between the carriage and the shoe sole of the invention, in which the complementary surfaces are a type of tongue and groove complementary surface.
Figure 7B:
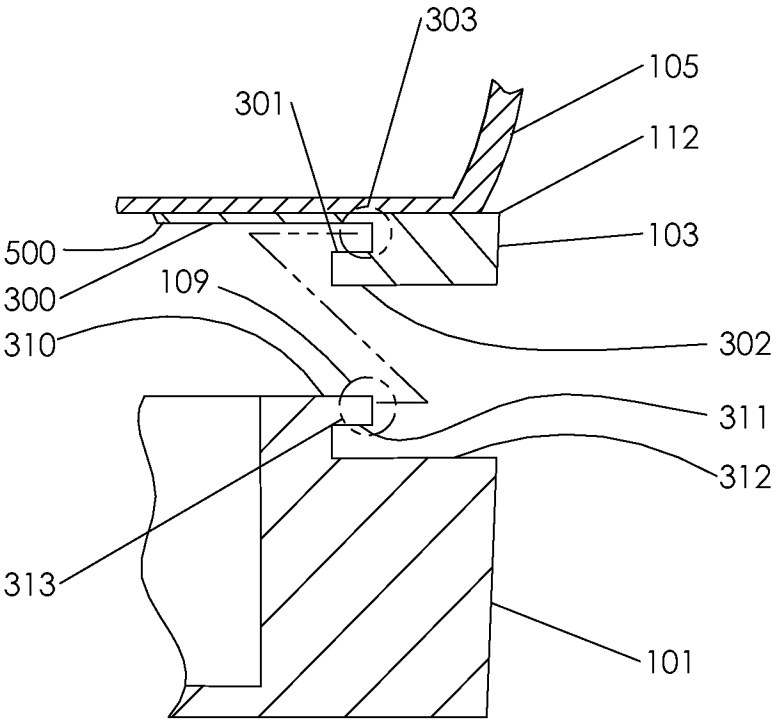
FIG. 7*b* depicts a first alternate embodiment of the complementary surfaces that comprise the sliding engagement between the carriage and the shoe sole of the invention, in which the complementary surfaces are an alternate type of tongue and groove complementary surface.
Figure 7C:
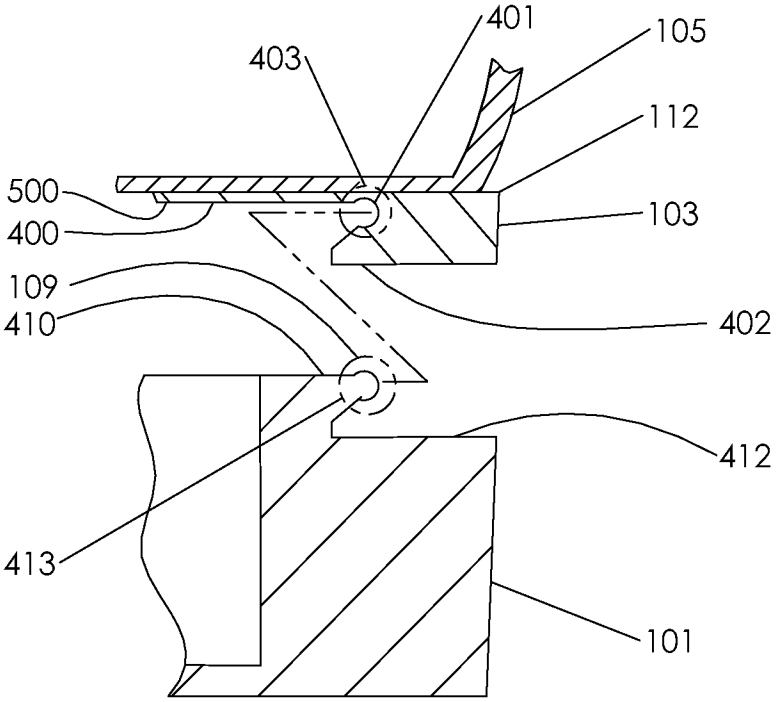
FIG. 7*c* depicts a second alternate embodiment of the complementary surfaces that comprise the sliding engagement between the carriage and the shoe sole of the invention, in which the complementary surfaces are an alternate type of tongue and groove complementary surface.

Referring now to FIGS. 7*a*, 7*b* and 7*c*, alternate embodiments of a par of opposed complementary sliding engagement surfaces 109 are depicted. Referring to FIG. 7*a*, a preferred embodiment of opposed complementary sliding engagement surfaces 109 is depicted in which surfaces 200, 201 and 202 of shoe sole 103 are in sliding engagement with surfaces 210, 211, 212 and 213 of carriage 101. Surfaces 200, 201, 202 and 203 of shoe sole 103 form an opposing complementary surface with surfaces 210, 211, 212 and 213 of carriage 101. These opposed complementary surfaces form a sliding engagement between carriage 101 and shoe sole 103, allowing carriage 101 to translate along a longitudinal axis of the shoe. Shoe upper 105 may be attached to shoe sole 103 or any intermediate structure (not shown) at sole-upper interface surface 112 by any means in the art including stitching, chemical bonding, or any means known in the art of shoe construction.

Referring next to FIG. 7*b*, a first alternate embodiment of opposed complementary sliding engagement surfaces 109 is depicted in which opposed complementary sliding engagement services 109 comprise an alternative tongue and groove complementary surface. Surfaces 300, 301, 302 and 303 of shoe sole 103 are in sliding engagement with surfaces 310, 311, 312 and 313 of carriage 101. Surfaces 300, 301, 302 and 303 of shoe sole 103 form a complementary surface with surfaces 310, 311, 312 and 313 of carriage 101. These opposed complementary surfaces form a sliding engagement between carriage 101 and shoe sole 103, allowing carriage 101 to translate along a longitudinal axis of the shoe. Shoe upper 105 may be attached to shoe sole 103 or any intermediate structure (not shown) at sole-upper interface surface 112 by any means in the art including stitching, chemical bonding, or any means known in the art of shoe construction.

Referring next to FIG. 7*c*, a second alternate embodiment of opposed complementary sliding engagement surfaces 109 is depicted in which opposed complementary sliding engagement surfaces 109 comprise an alternative tongue and groove complementary surface. Surfaces 400, 401, 402 and 403 of shoe sole 103 are in sliding engagement with surfaces 410, 411, 412 and 413 of carriage 101. Surfaces 400, 401, 402 and 403 of shoe sole 103 form a complementary surface with surfaces 410, 411, 412 and 413 of carriage 101. These opposed complementary surfaces form a sliding engagement between carriage 101 and shoe sole 103, allowing carriage 101 to translate along a longitudinal axis of the shoe. Shoe upper 105 may be attached to shoe sole 103 or any intermediate structure (not shown) at sole-upper interface surface 112 by any means in the art including stitching, chemical bonding, or any means known in the art of shoe construction.

Figure 8:
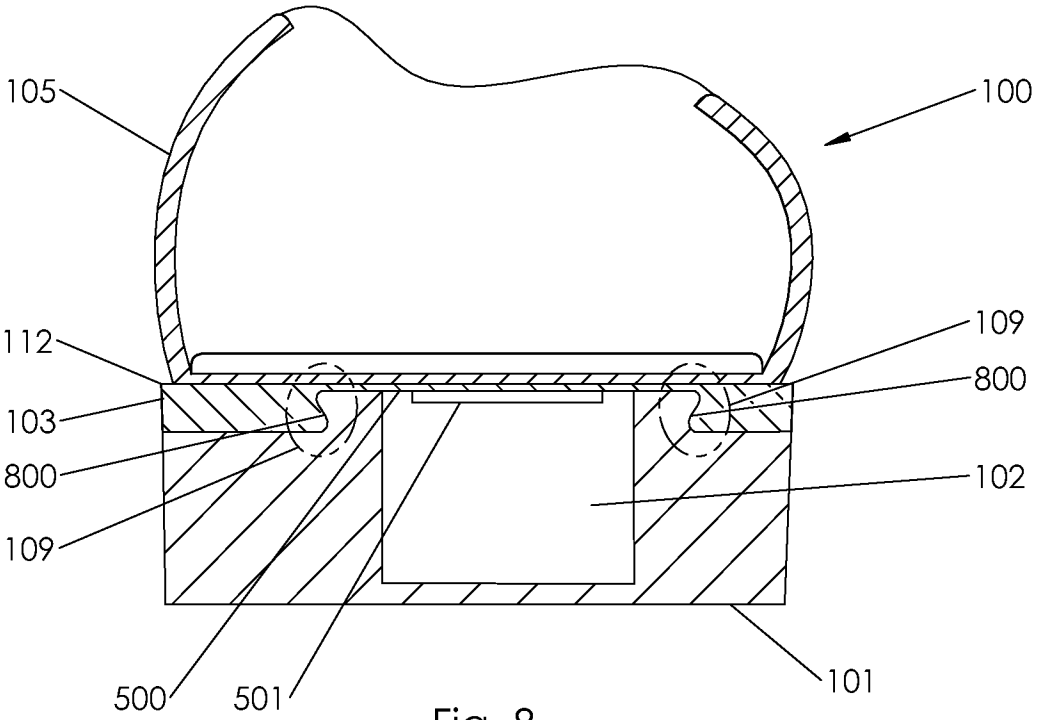
FIG. 8 depicts a cross section view of a third alternate embodiment of the complementary surfaces that comprise the sliding engagement between the carriage and the shoe sole of the invention.

Referring now to FIG. 8, a cross section of the invention 100 is depicted in which a third alternate embodiment of the pair of opposed complementary sliding engagement surfaces 109 is shown. Carriage 101 is in sliding engagement with shoe sole 103. Storage chamber 102, located in carriage 101, may be of any shape and may comprise storage chamber interior corners 110, which may be square corners, rounded internal corners, or corners of any shape. Storage chamber 102 may be rectilinear or curvilinear in shape, or may take any shape that fits within the envelope of carriage 101. Shoe upper 105 may be attached to shoe sole 103 or any intermediate structure (not shown) at sole-upper interface surface 112 by any means in the art including stitching, chemical bonding, or any means known in the art of shoe construction. It can be seen from the figure that the third alternate embodiment of the pair of opposed complementary sliding engagement surfaces 109 may comprise a pair of opposed curvilinear complementary surfaces 800 of the cross section depicted in the figure in carriage 101 and in shoe sole 103 that allow carriage 101 to translate along a longitudinal axis of the shoe. Optically reflective plate 501 may be attached to reflective plate mounting surface 500 of shoe sole 103 by any means known in the art including but not limited to chemical bonding and all equivalents thereof.

Figure 9:
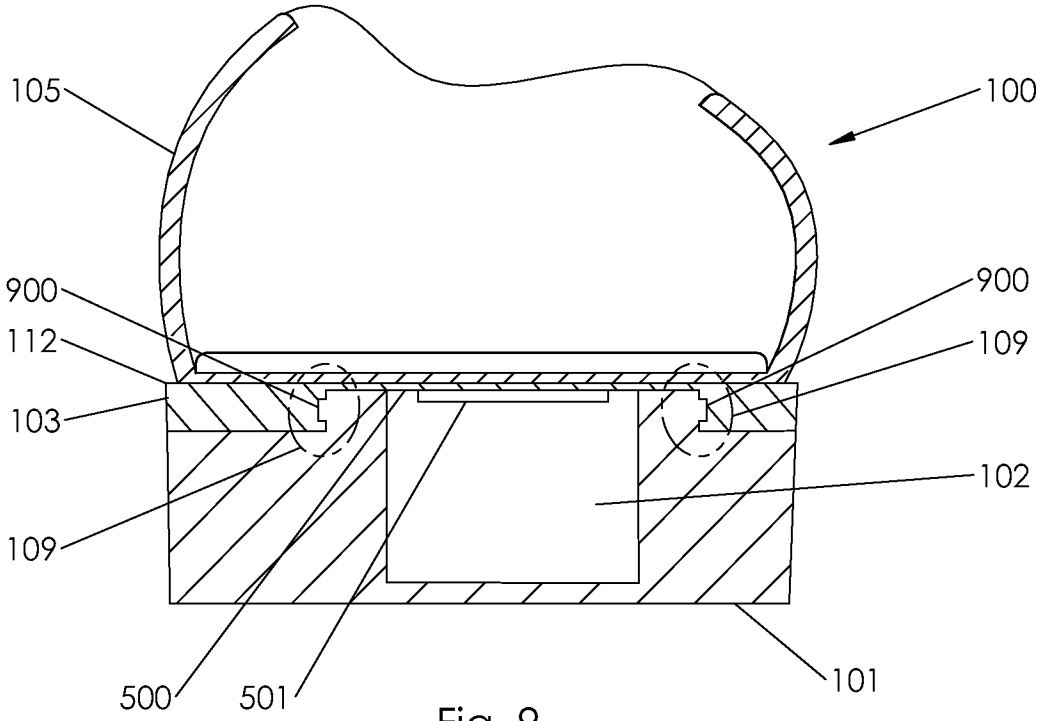
FIG. 9 depicts a cross section view of a fourth alternate embodiment of the complementary surfaces that comprise the sliding engagement between the carriage and the shoe sole of the invention.

Referring now to FIG. 9, a cross section of the invention 100 is depicted in which a fourth alternate embodiment of the pair of opposed complementary sliding engagement surfaces 109 of rectilinear cross section are shown. Carriage 101 is in sliding engagement with shoe sole 103. Storage chamber 102, located in carriage 101, may be of any shape and may comprise storage chamber interior corners 110, which may be square corners, rounded internal corners, or corners of any shape. Storage chamber 102 may be rectilinear or curvilinear in shape, or may take any shape that fits within the envelope of carriage 101. Shoe upper 105 may be attached to shoe sole 103 or any intermediate structure (not shown) at sole-upper interface surface 112 by any means in the art including stitching, chemical bonding, or any means known in the art of shoe construction. It can be seen from FIG. 9 that the fourth alternate embodiment of the pair of opposed complementary sliding engagement surfaces 109 comprises opposed rectilinear complementary surfaces 900 of the cross section depicted in the figure in carriage 101 and in shoe sole 103 that allow carriage 101 to translate along a longitudinal axis of the shoe. Optically reflective plate 501 may be attached to reflective plate mounting surface 500 of shoe sole 103 by any means known in the art including but not limited to chemical bonding and all equivalents thereof.

The pair of opposed complementary sliding engagement surfaces 109 that are depicted in the various figures of the drawings may take any shape that allows for sliding engagement between the carriage 101 and the shoe sole 103 of the invention, and the male and female elements of the pair of opposed complementary sliding engagement surfaces may be located in either the carriage or the shoe sole.

Figure 10A:
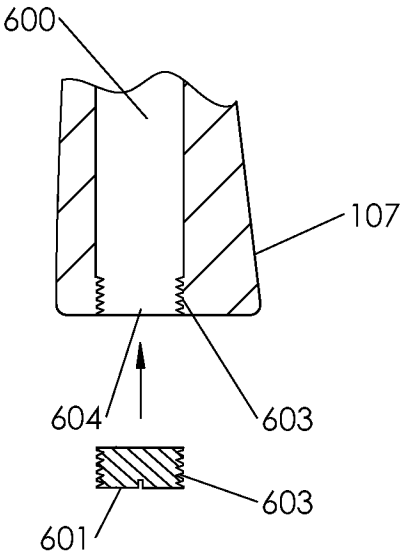
FIG. 10*a* depicts a cross section view of the heel of an alternate embodiment of the invention in which the heel of the shoe contains a storage chamber, and in which the heel chamber plug is shown separately from the heel storage chamber and showing the opening in the heel storage chamber.
Figure 10:
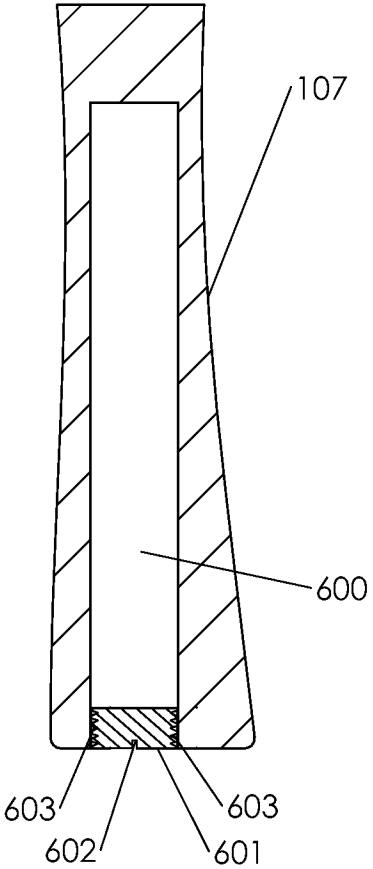
FIG. 10 depicts a cross section view of the heel of an alternate embodiment of the invention in which the heel of the shoe contains a storage chamber.

Referring now to FIG. 10, a cross section of the heel of an alternate embodiment of the invention is shown in which the heel of the shoe 107 further comprises heel storage chamber 600, which may be a void within heel 107 having an opening adapted to accept heel chamber plug 601 as described herein. Heel chamber plug 601 may be threadingly engaged with heel 107 by an attachment means which may comprise threads 603, which may further comprise a female thread in the opening in heel 107 and a matching male thread around the periphery of heel chamber plug 601 such that the female thread in heel 107 is adapted to receive the male threads of heel chamber plug 601. Heel chamber plug 601 may therefore be threadingly engaged with the opening of heel storage chamber 600 in heel 107, thereby forming a closed chamber in heel 107. The opening of heel storage chamber 600 may be cylindrical in shape in order to comprise female threads; the periphery of heel chamber plug may also be cylindrical in shape in order to comprise male threads that are adapted to threadingly engage with the female threads in the opening of heel storage chamber 600. Slot 602 may be provided in heel chamber plug 601 to assist the removal or insertion of heel chamber plug by allowing an instrument having a planar surface, such as for example a coin, to be inserted into slot 602 to assist a user in turning heel chamber plug 601 and to thereby operate the threading engagement of the male threads of heel chamber plug 601 with the female threads of heel 107. Threads 603 may be right hand threads, left hand threads, quarter turn threads, or any threads known in the mechanical arts. Thus heel chamber plug 601 may be threadingly engaged with heel 107, closing the opening in heel chamber 600.

Referring now to FIG. 10*a*, a cross section view of the heel of an alternate embodiment of the invention is depicted in which the heel of the shoe contains a storage chamber, and in which the heel chamber plug is shown separately from the heel storage chamber 600 and showing the opening in the heel storage chamber. Heel 107 may include a heel storage chamber 600 which has an opening 604, which may further comprise female threads 603 adapted to threadingly engage with matching male threads 603 on heel chamber plug 601 as shown in the figure. Heel chamber plug may therefore be threadingly engaged with opening 604 in heel storage chamber 600.

Figure 11:
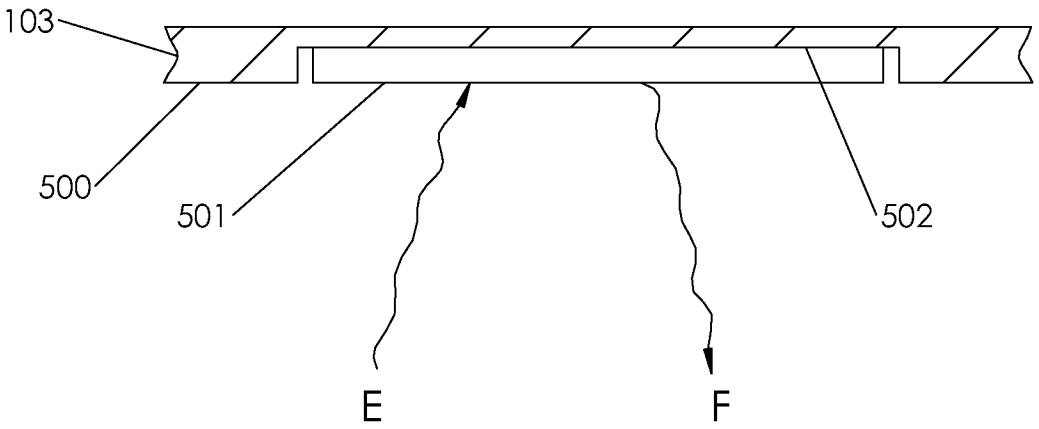
FIG. 11 depicts a cross section view of an alternate embodiment of the invention, in which the optically reflective plate is recessed into to the sole of the shoe.

Referring now to FIG. 11, a cross section view of an alternate embodiment of the optically reflective plate 501, which may be a mirror or polished metal plate or any optically reflective planar surface including deposited optically reflective surfaces, recessed into reflective surface mounting surface 500 is shown. In this alternate embodiment, optically reflective plate 501 is located within a recess disposed in reflective surface mounting surface 500 of shoe sole 103 as shown such that a user may remove the shoe from a foot, remove carriage 101 or simply slide carriage 101 towards the toe end of the shoe so as to expose all or a part of optically reflective plate 501, and view her reflection as reflected by optically reflective plate 501. Optically reflective plate 501 is therefore oriented such that its reflective surface reflects light impinging on the underneath of the shoe, as is further depicted in FIG. 5 which depicts a light ray E impinging on optically reflective plate 501 and being reflected as light ray F. Optically reflective plate 501 may be attached to surface 502 by any means known in the art such as, for example, chemical bonding or any other means known in the art for attaching planar surfaces. Optically reflective plate 501 may also be retained by press fit into the recess in reflective surface mounting surface 500 by dimensioning optically reflective plate 501 such that two or more of the sides of optically reflective plate 501 engage two or more of the side walls of the recess in disposed in reflective surface mounting surface 500 of shoe sole 103 in a press fit.

Figure 12:
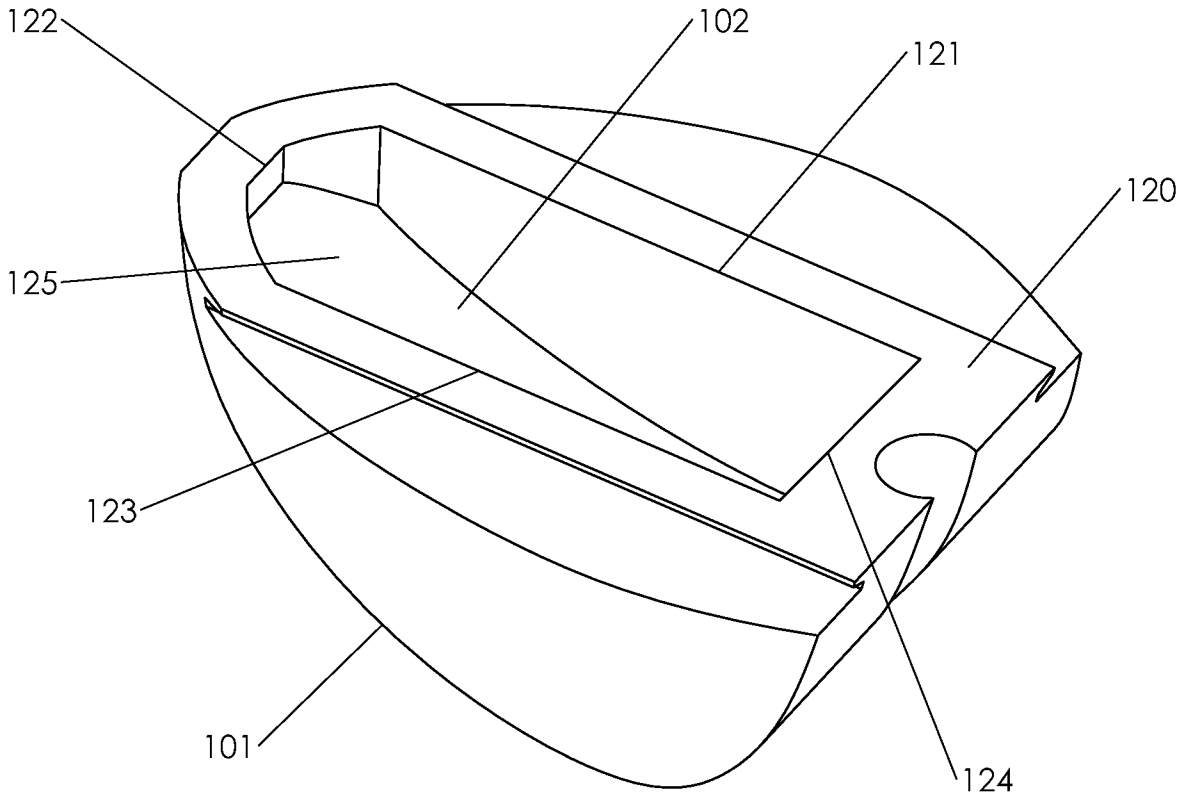
FIG. 12 depicts a top perspective view of the carriage of the invention.

Referring now to FIG. 12, carriage 101 is depicted in top perspective view. The pair of complementary surfaces which oppose the complementary surfaces disposed on the underneath side of shoe sole 103 (not shown in FIG. 12) and which provide a sliding engagement with shoe sole 103 may be disposed in a top surface 120 of carriage 101. Chamber 102 may be formed by contiguous sidewalls 121, 122, 123 and 124 and by bottom 125 and may have an open top. Carriage 101 may therefore have an open top that allows a user access to chamber 102 when carriage 101 is not in a closed position.

It is to be understood that the various elements of the invention may comprise any material known in the art of shoe making. Thus, the various components of the invention including carriage 101, shoe sole 103, carriage retaining pin 106, heel 107 and heel chamber plug 601 may be fabricated in whole or in part from rubber, wood, cork, plastics, leather, composite materials, metal, canvas, fabrics, petro-chemical materials and any other materials known in the art of shoe making, in any combination. The shoe sole 103, carriage 101, carriage retaining pin 106, heel 107 and heel chamber plug 601 of the invention may each be fabricated from unitary structure by any means known in the art or may be assembled from constituent elements for ease of manufacture or in order to keep manufacturing costs low. It is not necessary that the shoe sole 103 and the carriage 101 be fabricated from the same materials. Furthermore, optically reflective plate 501 may be fabricated as a mirror, for example a glass plate having a coated surface to provide light reflectivity, a metal reflective metal plate such as, for example, a polished metal plate, a reflective coating deposited directly on reflective surface mounting surface 500 or any planar object or surface that reflects light; i.e., is optically reflective. All forms of mirror known in the art and all forms of optically reflective coatings are included within the scope of the claims.

While the various figures of the drawings depict the shoe with integral storage chamber of the invention as being implemented in a women's-style shoe, it is to be understood that this representation is only one of many embodiments of the invention which includes all styles of shoes, either men's, women's or children's, including boots, sandals, clogs, athletic shoes, shoes with platform heels and all other styles and makes of shoes.

Although a detailed description as provided in the herein contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention. Thus, the scope of the invention should be determined by the appended claims and their legal equivalents, and not merely by the preferred examples or embodiments given.

What is claimed is:

1. An apparatus for storing objects in a shoe, comprising:

a shoe sole having an underneath surface; and a carriage comprising contiguous sidewalls, a bottom, an open top and a top surface;

wherein said contiguous sidewalls, said bottom and said open top form a chamber with an open top;

wherein said shoe sole and said carriage further comprise a pair of opposing complementary surfaces disposed in said underneath surface of said shoe sole and in said top surface of said carriage, wherein said pair of opposing complimentary surfaces provide sliding engagement between said shoe sole and said carriage allowing such that said carriage is able to be translated along a longitudinal axis of said shoe sole, and wherein said shoe sole is further defined as having a heel end, and wherein said shoe sole comprises a carriage retaining pin disposed in and extending from said underneath surface; and wherein said carriage further comprises a retaining pin receiving recess for receiving said retaining pin in a snap fit when said carriage is translated along said sliding engagement toward said heel end of said sole into a closed position located at the limit of sliding engagement toward said heel end of said shoe sole.

2. The apparatus for storing objects in a shoe of claim 1, wherein said pair of opposing complementary surfaces is further defined as comprising a pair of opposing tongue and groove complementary surfaces.

3. The apparatus for storing objects in a shoe of claim 1, wherein said pair of opposing complementary surfaces is further defined as a pair of opposing curvilinear complementary surfaces.

4. The apparatus for storing objects in a shoe of claim 1, wherein said pair of opposing complementary surfaces is further defined as a pair of opposing rectilinear complementary surfaces.

5. The apparatus for storing objects in a shoe of claim 1, further comprising an optically reflective plate attached to an underneath surface of said shoe sole.

6. The apparatus for storing objects in a shoe of claim 1, further comprising:

wherein said sole is further defined as having a heel comprising a void, wherein said void comprises an opening comprising female threads; and wherein said apparatus further comprises a plug comprising male threads;

wherein said male threads of said plug are adapted to be threadingly engaged with said female threads of said void opening, thereby closing said opening in said void.

7. The apparatus for storing objects in a shoe of claim 2, further comprising:

wherein said sole is further defined as having a heel comprising a void, wherein said void comprises an opening comprising female threads; and wherein said apparatus further comprises a plug comprising male threads;

wherein said male threads of said plug are adapted to be threadingly engaged with said female threads of said void opening, thereby closing said opening in said void.

8. The apparatus for storing objects in a shoe of claim 3, further comprising:

wherein said sole is further defined as having a heel comprising a void, wherein said void comprises an opening comprising female threads; and wherein said apparatus further comprises a plug comprising male threads;

wherein said male threads of said plug are adapted to be threadingly engaged with said female threads of said void opening, thereby closing said opening in said void.

9. The apparatus for storing objects in a shoe of claim 4, further comprising:

wherein said sole is further defined as having a heel comprising a void, wherein said void comprises an opening comprising female threads; and wherein said apparatus further comprises a plug comprising male threads;

wherein said male threads of said plug are adapted to be threadingly engaged with said female threads of said void opening, thereby closing said opening in said void.

10. The apparatus for storing objects in a shoe of claim 5, further comprising:

wherein said sole is further defined as having a heel comprising a void, wherein said void comprises an opening comprising female threads; and wherein said apparatus further comprises a plug comprising male threads;

wherein said male threads of said plug are adapted to be threadingly engaged with said female threads of said void opening, thereby closing said opening in said void.

11. A shoe with an integral storage chamber, comprising:

a shoe sole having an underneath surface; and a carriage comprising contiguous sidewalls, a bottom, an open top and a top surface;

wherein said contiguous sidewalls, said bottom and said open top form a chamber with an open top;

wherein said shoe sole and said carriage further comprise a pair of opposing complementary surfaces disposed in said underneath surface of said shoe sole and in said top surface of said carriage, and wherein said pair of opposing complimentary surfaces provide sliding engagement between said shoe sole and said carriage allowing such that said carriage is able to be translated along a longitudinal axis of said shoe sole, and wherein said shoe sole is further defined as having a heel end, and wherein said shoe sole comprises a carriage retaining pin disposed in and extending from said underneath surface; and wherein said carriage further comprises a retaining pin receiving recess for receiving said retaining pin in a snap fit when said carriage is translated along said sliding engagement toward said heel end of said sole into a closed position located at the limit of sliding engagement toward said heel end of said shoe sole.

12. The shoe with an integral storage chamber of claim 11, wherein said pair of opposing complementary surfaces is further defined as a pair of opposing tongue and groove complementary surfaces.

13. The shoe with an integral storage chamber of claim 11, wherein said pair of opposing complementary surfaces is further defined as a pair of opposing curvilinear complementary surfaces.

14. The shoe with an integral storage chamber of claim 11, wherein said pair of opposing complementary surfaces is further defined as a pair of opposing rectilinear complementary surfaces.

15. The shoe with an integral storage chamber of claim 11, further comprising an optically reflective plate attached to an underneath surface of said shoe sole.

16. The shoe with integral storage chamber of claim 11, further comprising:

a heel comprising a void, wherein said void comprises an opening comprising female threads; and a plug comprising male threads;

wherein said male threads of said plug are adapted to be threadingly engaged with said female threads of said void opening, thereby closing said opening in said void.

17. The shoe with integral storage chamber of claim 12, further comprising:

a heel comprising a void, wherein said void comprises an opening comprising female threads; and a plug comprising male threads;

wherein said male threads of said plug are adapted to be threadingly engaged with said female threads of said void opening, thereby closing said opening in said void.

18. The shoe with integral storage chamber of claim 13, further comprising:

a heel comprising a void, wherein said void comprises an opening comprising female threads; and a plug comprising male threads;

wherein said male threads of said plug are adapted to be threadingly engaged with said female threads of said void opening, thereby closing said opening in said void.

19. The shoe with integral storage chamber of claim 14, further comprising:

a heel comprising a void, wherein said void comprises an opening comprising female threads; and a plug comprising male threads;

wherein said male threads of said plug are adapted to be threadingly engaged with said female threads of said void opening, thereby closing said opening in said void.

20. The shoe with integral storage chamber of claim 15, further comprising:

a heel comprising a void, wherein said void comprises an opening comprising female threads; and a plug comprising male threads;

wherein said male threads of said plug are adapted to be threadingly engaged with said female threads of said void opening, thereby closing said opening in said void.

* * * * *